United States Patent [19]

Schiele et al.

[11] Patent Number: 4,487,104

[45] Date of Patent: Dec. 11, 1984

[54] CONTAINER FOR THE PICKUP AND FEED OF A CARTRIDGE

[75] Inventors: August Schiele, Augsburg; Helmut Janda, Schwabmünchen, both of Fed. Rep. of Germany

[73] Assignee: Firma Keller & Knappich Wehrtechnik GmbH, Fed. Rep. of Germany

[21] Appl. No.: 295,602

[22] Filed: Aug. 19, 1981

[30] Foreign Application Priority Data

Aug. 19, 1980 [DE] Fed. Rep. of Germany ..... 3031203

[51] Int. Cl.[3] ..... F41F 9/06

[52] U.S. Cl. ..... 89/34

[58] Field of Search ..... 89/34, 35 R, 45, 46, 89/47

[56] References Cited

U.S. PATENT DOCUMENTS 3,688,639 9/1972 Hayes ..... 89/45

FOREIGN PATENT DOCUMENTS 2948146 6/1980 Fed. Rep. of Germany ..... 89/47

*Primary Examiner*—Stephen C. Bentley

*Attorney, Agent, or Firm*—McGlew and Tuttle

[57] ABSTRACT

A container is open on both sides and is used for the pickup and feed of a cartridge having a bottom flange. The container is a component of a magazine revolving behind a cannon across the bore axis thereof on an endless-track disposed in the turret of a tank, or especially of an armored car. In the container, the cartridge lies in the grip of at least two pincers, which are in interconnection with the container in jacket perforations thereof and which can be tightened by means of a cam interacting with a sliding sleeve.

6 Claims, 7 Drawing Figures

CONTAINER FOR THE PICKUP AND FEED OF A CARTRIDGE

FIELD AND BACKGROUND OF THE INVENTION

The present invention relates to a container which is open on both sides, and which is used for the pickup and feed of a cartridge having a bottom flange. The container is a component of a magazine revolving behind a cannon across the bore axis thereof on an endless-track disposed in the turret of a tank, or especially of an armored car. In the container, the cartridge lies in the grip of at least two pincers, which are in interconnection with the container in jacket perforations thereof and which can be tightened by means of a cam interacting with a sliding sleeve.

The equipment of such a container with at least two pincers, as known, e.g. German Offenlegungsschrift No. 2,948,146, allows only for a positive locking of the cartridge tranverse to its longitudinal direction. In a longitudinal direction its locking is restricted to a frictional engagement. According to an understanding which underlies the present invention, this is not good enough for meeting the cross-country requirements to be met by current-type armored vehicles for a safe storage of ammunition having a partially combustible case, and its feed to the cannon.

SUMMARY OF THE INVENTION

The object of the present invention, therefore, is to improve such ammunition containers to the effect that they provide the cartridge also with an axially fixed positive lock.

This problem is solved according to the invention by providing at least two pawls being set in perforations in the container jacket, which adjoin stops associated with the cartridge bottom flange shoulder ring. These pawls are coupled with a sliding sleeve by a rod linkage, which at each container setting are aligned with the cannon barrel bore axis and are axially slidable by two tank turret disposed pins that are preferably controlled by electromagnetic means. At least two spring pawls having a cam rise slant are also externally assigned to the cartridge bottom.

According to the invention the pawls applied to the cartridge bottom flange on the one hand, and the spring pawls on the other hand, form a positive-locking axial lock and that way represent a considerably improved suitability of the container for an automatic loading device per se, and for a sensitive type of ammunition in particular. In this case the pawls together with the sliding sleeve are controlled via a common rod linkage. This control is also optionally triggered, e.g. if on the weapon side internally the container is to be charged manually with a new cartridge. In this case of manually charging the container with a new cartridge the spring pawl with its stopping face acting from the outside yields to this action without any trouble. The other pawl, which is to apply its stop to the shoulder ring of the cartridge bottom flange, must be preset to this effect, for which purpose its control bolt is axially shifted only over a partial length to the extent of having the sliding sleeve for the pincer cams stop short of externally gripping the cartridge in front.

Practicably the pawls are equipped with clamping jaws for the cartridge. In this way, and with only a minor engineering input, a secondary radial mounting can be effected.

For practical purposes the rod linkage is put under the load of a compression spring acting in a direction from cartridge tip to cartridge bottom. Thus the electromagnet has to be effective only in one direction and allows for a greater play on the pin, which being disposed in the tank turret is to maintain a safe clearance distance from the track of the revolving magazine.

BRIEF DESCRIPTION OF THE DRAWINGS

An exemplified embodiment of the invention is illustrated in the attached drawings, wherein.

DESCRIPTION OF THE PREFERRED EMBODIMENT

Figure 1:
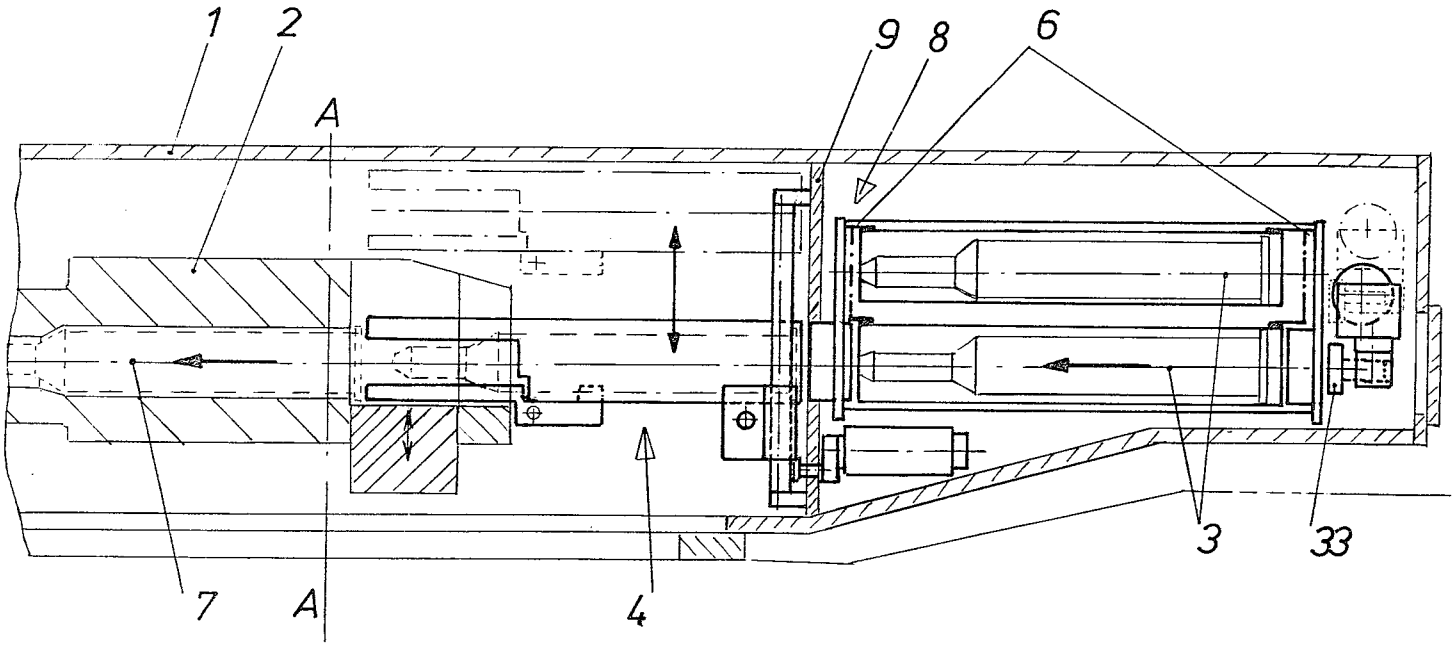
FIG. 1 is a longitudinal vertical sectional view of a tank turret rear area.
Figure 2:
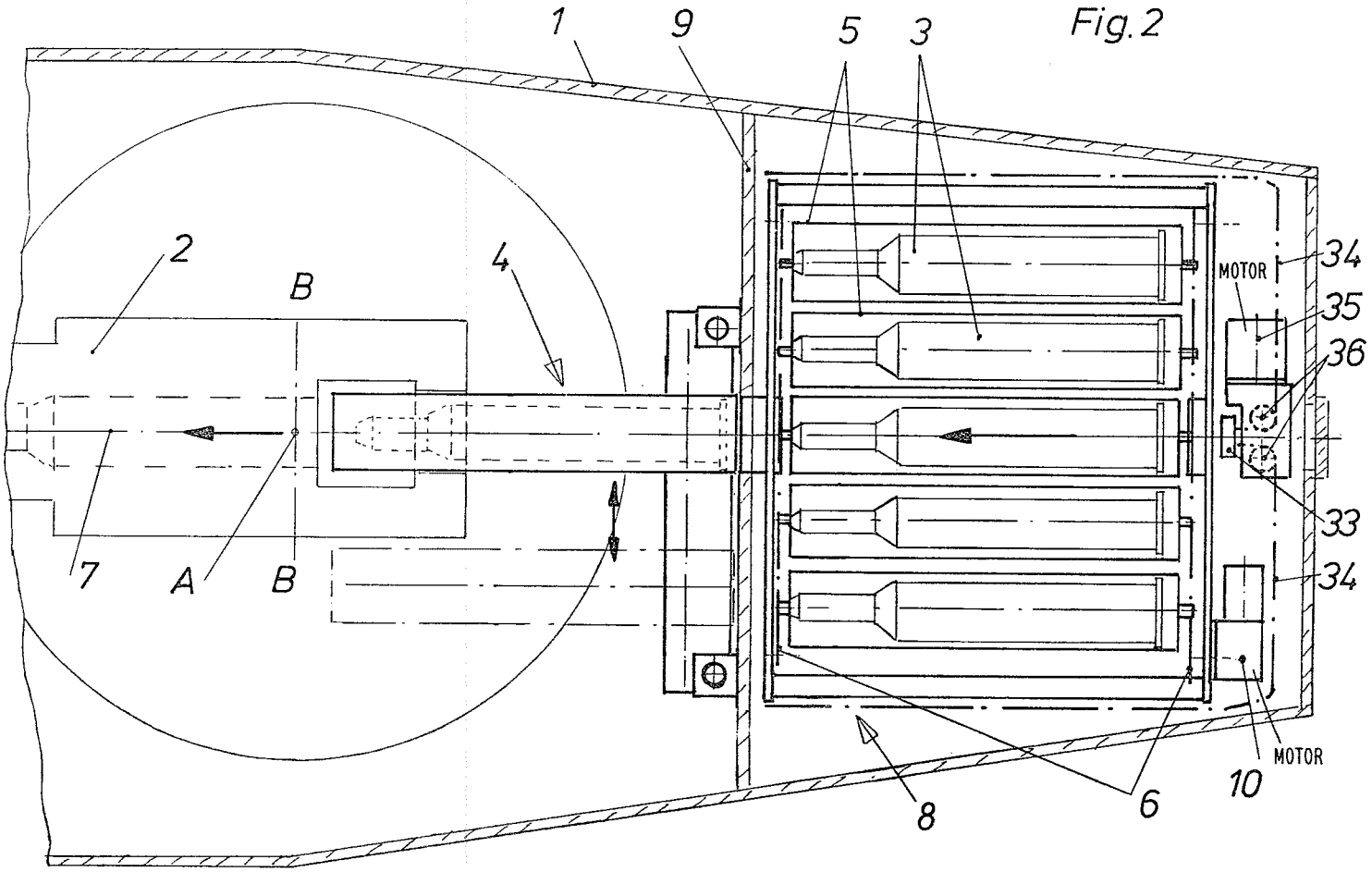
FIG. 2 a top view of FIG. 1.

FIGS. 1 and 2 show the rear area of a tank turret 1, which is pivotable around an upright axis line A—A. In turret 1*a* cannon 2 is supported and upwardly tiltable around a trunnion line B—B. The cannon 2 is loaded via a loading ramp 4, with a cartridge 3 from one of the bilaterally open containers 5, which are components of a magazine 8 revolving on an endless-track 6 of a pair of chains across the bore axis 7 of cannon 2. In this case, the container 5 from which the loading is accomplished, is disposed at the bottom end of the endless-track 6 in a position aligned with the bore axis 7 of cannon 2. For this purpose the cannon 2 is swiveled into its zero elevation positions, shown in FIGS. 1 and 2. At this alignment angle the partition wall 9, which separates the magazine 8 from the rest of the tank turret space, has a hole. Revolutions of the magazine 8 along conveyor chain track 6 can be powered by a motor 10 or under emergency conditions also by manual means.

Figure 3:
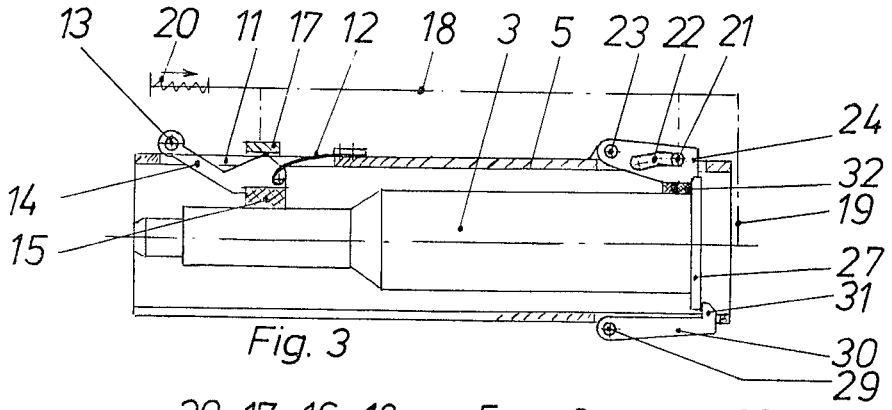
FIGS. 3–6 are sectional view of a container with a cartridge in four various clamping positions.
Figure 4:
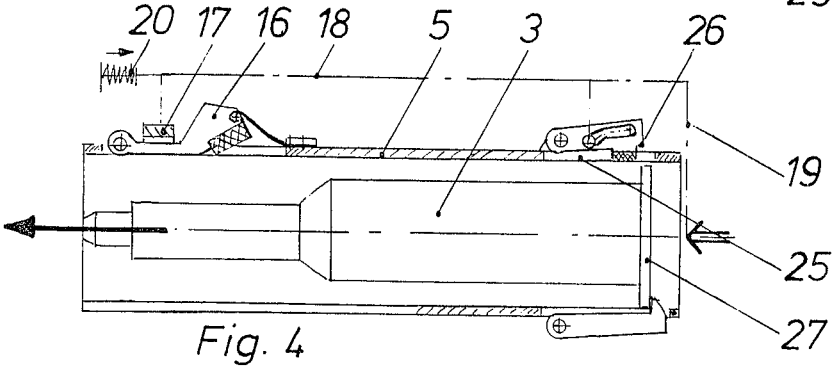
Figure 5:
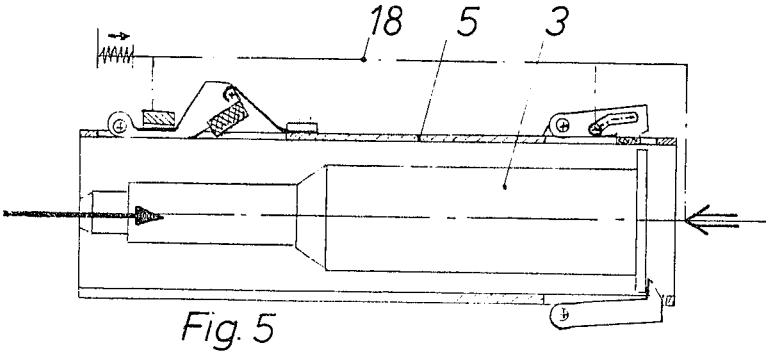

Each container 5 has three perforations 11 distributed over its jacket periphery wherein lever arms 14 having pincers 15 attached thereto can be swiveled into position around joints 13 for clamping the cartridge 3. While countering the force of a leaf spring 12 provided to lift the lever arm 14 with its attached cam 16 over the outer jacket of container 5. The force of each spring 12 is counteracted by an inward-pushing sliding sleeve 17 to cause the pincers 15 to clamp the cartridge 3 in a positive-locking and vibration-free way. The sliding sleeve 17 has a circular shape and is connected to two stops 19 for pins 38, which are disposed on both sides of the container 5 being aligned in the tank turret with the cannon barrel bore axis 7 via a plurality of peripherally distributed rod lengths 18, of which only one is indicated in FIGS. 3 thru 6 and shown in FIG. 7, and/or via a rod cage having two stops 19 for pins 38. Using a stationary shown schematically only by arrows in FIG. 7) electromagnet the rod lengths 18 or the rod cage respectively can be so axially shifted to the left in FIG. 7, against the bias of at least one compression spring 20 provided at the opposite end of 18, by the pins 38 which are acted upon in the direction of the arrows. In this way, the pincers 15 are moved out of their clamping position (FIG. 4). This clamping position shown in FIG. 3 is locked up by the force of the spring 20, which is backed by the container.

Figure 6:
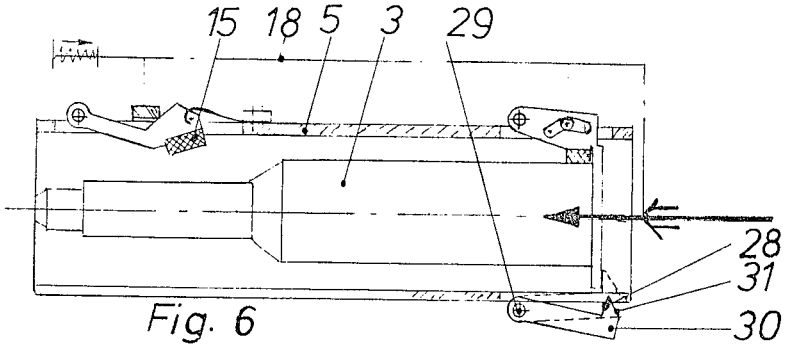

In rigid interconnection with the rod linkage 18, 19 there is also a bolt 21, which engages a slot 22 in a pawl 24 linked at the point 23 of container 5, which pawl is enabled to emerge into the jacket of container 5 through perforation 25. A stop 26 is associated with pawl 24 and is shaped to engage against the shoulder ring of the bottom flange 27 of cartridge 3. A plurality of pawls 24 are provided. To the underside of bottom flange 27 a hook 28 of a spring pawl 30, which is linked at 29, is applied (FIG. 6). While the spring pawl or catches 30 constantly projecting into the jacket of container 5 through a perforation thereof is swiveled out at its stopping face 31 only on the external charging of container 5 as indicated by the arrow in FIG. 6, the pawl 24, which for a subsequent radial clamping of the container simultaneously can be equipped with a pincer 32, can be controlled, aside from its clamping position shown in FIG. 3 and locked up by spring 20, both for loading the cannon with a cartridge according to FIG. 4 and for the internal charging of container 5 with a new cartridge according to FIG. 5 or for its external charging via rods 18 according to FIG. 6. In their operational settings according to FIGS. 4 and 5 the pawls 24 and pincers 15 are synchronously deactivated. On external charging according to FIG. 6, however, the pawl 24 must be set ready for catching the bottom flange shouler ring 27 while the pincers 15 must be kept open. For this purpose the sliding sleeve 17 relative to the cam 16, which it controls, has a return stroke section representing the axial stroke projection of a power stroke section of the slot 22 of pawl 24, which, being drawn on the left in FIGS. 3–6, can be seen in FIG. 6. Following the charging according to FIG. 6 the remaining axial stroke is completed on rod linkage 18, until the position of FIG. 3 is reached again.

To load the cannon or gun 2 via the loading ramp 4 the cartridge 3 is pushed out of container 5, which is in the position according to FIG. 4 in the direction of the arrows, by the ram 33 (FIG. 2). For this purpose the latter is activated by a motor 35 or under emergency conditions by manually operated deflector rollers 36.

Figure 7:
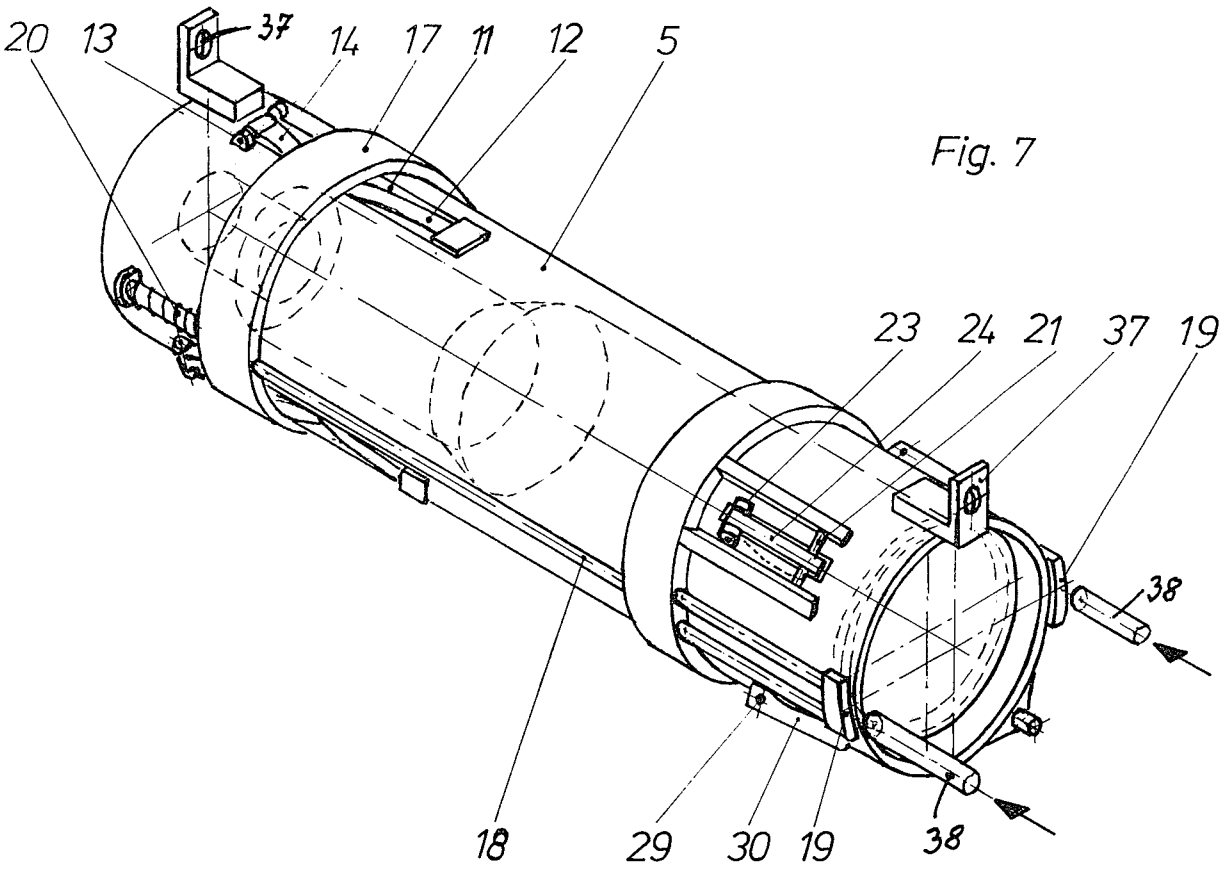
FIG. 7 is a perspective external view of the container.

FIG. 7 gives a perspective external view of the container 5 with rod linkage 18 and both limit stops 19 for the pins 38 being disposed in the tank turret charging station. Also shown are the points of linkage 37 of container 5 to the endless track 6 of revolving magazine 8 formed by chain pairs (not shown in FIG. 7).

We claim:

1. In a magazine for the gun of an armored vehicle, having an endless track with a plurality of cartridge containers each for containing a cartridge having a bottom flange, the improvement wherein each of the containers comprises:

a jacket having opposite open ends for receiving and discharging a cartridge, at least two first perforations and at least two second perforations intermediate said opposite ends;

a pincer pivotally mounted to said jacket adjacent each of said at least two first perforations and movable into each of said at least two first perforations for frictionally engaging a cartridge in said jacket, each pincer having a cam surface;

a pawl pivotally mounted to sid jacket adjacent each of said at least two second perforations and movable into each of said at least two second perforations for engaging a cartridge in said jacket, each pawl having a limit stop shaped to engage at least a top surface of a cartridge bottom flange in said jacket for positively holding a cartridge in said jacket from exiting said jacket through one of said opposite openings;

a sliding sleeve slidable over said jacket adjacent said at least two first perforations for engaging said cam surface of each pincer to move each pincer into engagement with a cartridge in said jacket;

a plurality of rods connected to said sliding sleeve and slidably mounted with respect to said jacket;

said magazine including at least two pins movably mounted with respect to said jacket when said jacket is in alignment with the gun of the armored vehicle, for engaging said rods to move said sliding sleeve;

drive means connected to said magazine for moving said at least two pins;

each pawl operatively connected to said rods and sliding sleeve for moving into and out of engagement with a cartridge in said jacket with movement of said rods and sliding sleeve; and at least two spring catches pivotally mounted to said jacket and movable into engagement with a bottom surface of a cartridge bottom flange in said jacket to hold a cartridge from movement from the other of said open ends.

2. In a magazine according to claim 1, the improvement wherein each pawl includes a clamping jaw connected thereto for frictionally engaging a cartridge in said jacket.

3. In a magazine according to claim 2, the improvement including at least one compression spring engaged with at least one of said rods for biasing said sliding sleeve into engagement with each cam surface to move each pincer into engagement with a cartridge in said jacket.

4. In a magazine according to claim 1, the improvement including a bolt connected to each rod, a cam slot defined in each pawl in which each bolt is slidable for moving each pawl with movement of said rod, each cam slot and each cam surface having a shape, and said pawls operatively interconnected with said pincers so that with movement of said sliding sleeve in a first direction to release said pincers from a cartridge in said jacket, said pawls are moved to release a cartridge in said jacket, and with movement of said sliding sleeve in an opposite direction by an amount to partially move said pincers, said pawls are moved into full engagement with a cartridge in said jacket.

5. In a magazine according to claim 2, the improvement including a bolt connected to each rod, a cam slot defined in each pawl and in which each bolt is slidable for moving each pawl with movement of said rod, each cam slot and each cam surface having a shape, and said pawls operatively interconnected with said pincers so that with movement of said sliding sleeve in a first direction to release said pincers from a cartridge in said jacket, said pawls are moved to release a cartridge in said jacket, and with movement of said sliding sleeve in an opposite direction by an amount to partially move said pincers, said pawls are moved into full engagement with a cartridge in said jacket.

6. In a magazine according to claim 3, the improvement including a bolt connected to each rod, a cam slot defined in each pawl and in which each bolt is slidable for moving each pawl with movement of said rod, each cam slot and each cam surface having a shape, and said pawls operatively interconnected with said pincers so that with movement of said sliding sleeve in a first direction to release said pincers from a cartridge in said jacket, said pawls are moved to release a cartridge in said jacket, and with movement of said sliding sleeve in an opposite direction by an amount to partially move said pincers, said pawls are moved into full engagement with a cartridge in said jacket.

* * * * *

UNITED STATES PATENT AND TRADEMARK OFFICE

CERTIFICATE OF CORRECTION

PATENT NO. : 4,487,104

DATED : December 11, 1984

INVENTOR(S) : August Schiele

It is certified that error appears in the above-identified patent and that said Letters Patent is hereby corrected as shown below:

On the title page, assignee should read

-- KUKA Wehrtechnik GmbH, Augsburg, Germany --.

Signed and Sealed this

*Seventh* Day of *May 1985*

[SEAL]

*Attest:*

DONALD J. QUIGG

*Attesting Officer* *Acting Commissioner of Patents and Trademarks*